US007083482B2

(12) United States Patent
Bouge et al.

(10) Patent No.: US 7,083,482 B2
(45) Date of Patent: Aug. 1, 2006

(54) MARINE ENGINE STOPPING DEVICE

(76) Inventors: Harry A. Bouge, 6680 Lockheed Dr., Redding, CA (US) 96002; Keith Jackson, 6680 Lockheed Dr., Redding, CA (US) 96002

( * ) Notice: Subject to any disclaimer, the term of this patent is extended or adjusted under 35 U.S.C. 154(b) by 0 days.

(21) Appl. No.: 10/989,305

(22) Filed: Nov. 17, 2004

(65) Prior Publication Data

US 2006/0105643 A1 May 18, 2006

(51) Int. Cl.
*B63H 21/22* (2006.01)

(52) U.S. Cl. ..... 440/1

(58) Field of Classification Search ..... 440/1
See application file for complete search history.

(56) References Cited

U.S. PATENT DOCUMENTS

| | | | | |
|---|---|---|---|---|
| 4,305,143 | A * | 12/1981 | Simms et al. | 367/134 |
| 5,838,227 | A * | 11/1998 | Murray | 340/539.21 |
| 6,157,303 | A | 12/2000 | Bodie et al. | |
| 6,276,974 | B1 * | 8/2001 | Bouge et al. | 440/1 |
| 6,317,050 | B1 * | 11/2001 | Burks | 340/573.6 |
| 2002/0052159 | A1 * | 5/2002 | Eguchi | 441/80 |

* cited by examiner

*Primary Examiner*—Stephen Avila
(74) *Attorney, Agent, or Firm*—Theodore J. Bielen, Jr.

(57) ABSTRACT

A device for shutting off or stopping a marine engine ignition system utilizing a transmitter for generating a wireless signal. The wireless signal is only generated upon association of the transmitter with a mass of water. A receiver acquires the wireless signal and generates a disconnection signal which interrupts the operation of a marine engine.

15 Claims, 3 Drawing Sheets

MARINE ENGINE STOPPING DEVICE

BACKGROUND OF THE INVENTION

The present invention relates to a novel and useful device for shutting off a marine engine ignition system.

Persons on a boat have been known to fall overboard without being detected by the operator of the boat. In such cases, the person is often lost or drowns before being found. In addition, sole operators of boats have fallen overboard resulting in the boat continuing its operation without an operator. Such runaway boats have been known to seriously injure the operator of the boat in the water since a runaway boat tends to circle back to the place where the operator has fallen overboard. Such injuries are normally caused by the propeller of the boat cutting the operator in the water, or by the boat itself ramming the operator in the water.

A water safety transmitter and receiver has been developed to indicate the accidental entry of a child into a swimming pool or body of water. Such water safety transmitter and receiver is shown in U.S. Pat. No. 6,157,303 and is designed to be worn on the wrists of the child when the child is near a body of water.

A marine system which is capable of stopping the engine of a boat if an operator or passenger falls overboard would be a notable advance in the field of marine safety.

BRIEF SUMMARY OF THE INVENTION

In accordance with the present invention a novel and useful device for shutting off a marine engine ignition system is herein provided.

The system of the present invention utilizes a transmitter for generating a wireless signal upon association with water. Such transmitter may be worn by the operator of a boat or a passenger on a boat by placement on a lanyard about the neck of the person or on a strap which may fit around the wrist or ankle of a person.

A receiver is also employed and is mounted at the boat for acquiring the wireless signal from the transmitter. The wireless signal is transformed into an output signal which activates a disconnection apparatus for interrupting the operation of the marine engine ignition system. Such output signal may take the form of an electrical signal which is capable of operating a relay in a circuit that is employed to interrupt the normal ignition voltage required to start the ignition system of a marine engine.

Also, an override mechanism may be employed in the present invention to reactivate the marine engine ignition system following interruption by the disconnection apparatus. Such override mechanism may take the form of an override switch and be accompanied by a signal indicating that the disconnection of the marine engine has taken place. In certain case, multiple override initiators may be employed in the present invention and be located remotely relative to each other on the marine craft.

In addition, an alerting mechanism such as an audio alarm could be connected to the override mechanism such that it is activated when the override mechanism is activated.

Moreover, the device of the present invention may further include a switch which is activated upon the initiation of another event on the marine craft or boat. For example, if a marine ladder is positioned along the side of the boat and into the water, a switch may be activated at that place. Such switch would generate a positioning signal which would be acquired by the receiver and, in turn, would generate its activation signal shutting down the marine engine.

It should be noted that the system of the present invention is adaptable for use with inboard or outboard marine engines. Thus, the disconnection apparatus may include the interruption of voltage or the connection of a ground to the marine engine, as the case may be.

It may be apparent that a novel and useful device for shutting off of a marine engine of a boat has been hereinabove described.

It is therefore an object of the present invention to provide a device for shutting off a marine engine which is capable of operating by a wireless signal generated when a person is in contact with the water.

Another object of the present invention to provide a device for shutting off a marine engine which utilizes a transmitter that may be worn by a person on the boat and is activated when that person falls overboard, generating a signal that interrupts the ignition system of the marine engine.

Another object of the present invention to provide a device for shutting off a marine engine which is capable of operating upon the receipt of multiple signals, each of which indicating an emergency condition requiring the turning off of the marine engine.

A further object of the present invention to provide a device for shutting off a marine engine which prevents a person who has fallen overboard from being injured by the movement of the boat subsequent to their entry into the water.

Another object of the present invention to provide a device for shutting off a marine engine which greatly advances marine safety.

The invention possesses other objects and advantages especially as concerns particular characteristics and features thereof which will become apparent as the specification continues.

Figure 1:
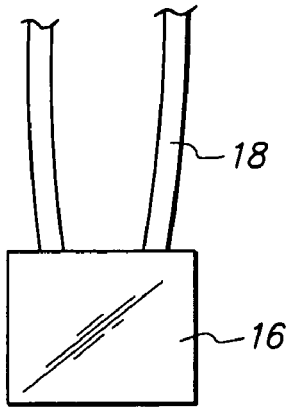
FIG. 1 is a top plan view of the transmitter of the present invention attached to a lanyard partially shown.

Reference is made to the following detailed description of the preferred embodiments which should be taken in conjunction with the prior described drawings.

DETAILED DESCRIPTION OF THE PREFERRED EMBODIMENTS OF THE INVENTION

Various aspects of the present invention will evolve from the following detailed description of the preferred embodiments thereof which are best referenced to the prior delineated drawings.

An embodiment of the invention is shown in the drawings by reference character 10. The device 10 is intended to turn off a marine engine 12 which is normally used to propel a boat 14. As there are generally two types of marine engines, the inboard and outboard versions are differentiated by an upper case letter.

Figure 2:
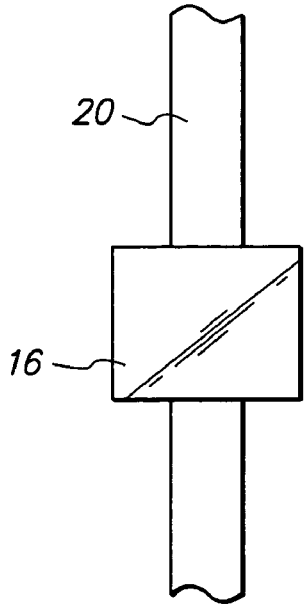
FIG. 2 is a top plan view of the transmitter of the present invention on a wrist or ankle band partially shown.
Figure 3:
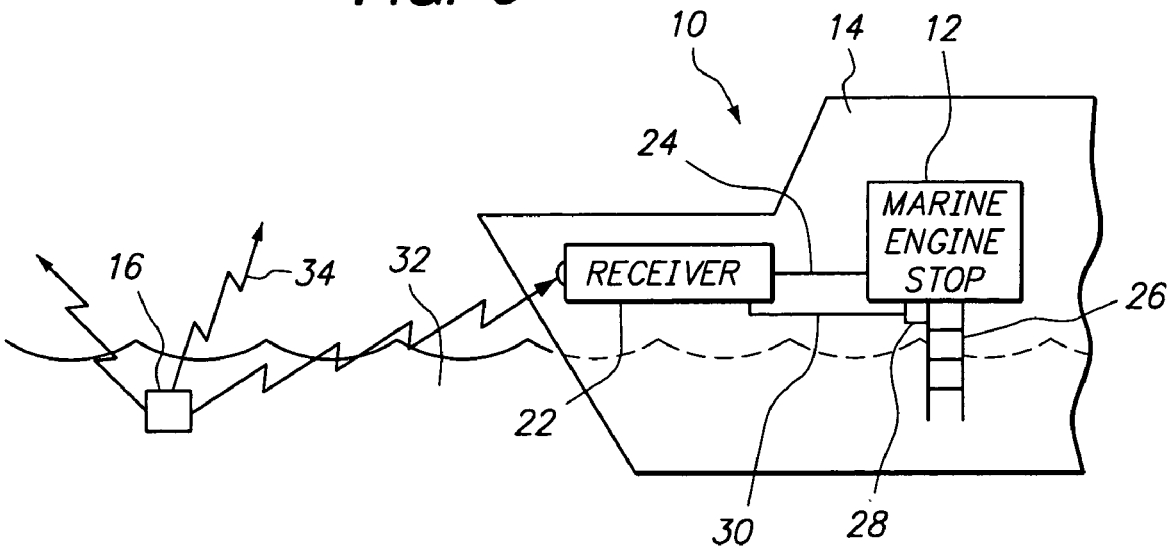
FIG. 3 is a schematic viewing indicating the activation of the transmitter by contact with water, the receiver, and an engine stopping mechanism on the boat, partially shown.

The system of the present invention is intended to act as a safety device by shutting down any of the marine engines 12A or 12B of boat 14. Device 10 includes as one of its elements a transmitter 16 which is of the type described in U.S. Pat. No. 6,157,303. In that reference, a transmitter which is activated by contact with water, generates a radio signal to set off an alarm indicating that a child wearing such transmitter 16 has come in contact with water in a swimming pool, lake, and the like. As is evidenced by FIGS. 1 and 2, receiver 16 may be connected to a lanyard 18 or a band 20, that may fit around the ankle or wrist of a person. It is intended that transmitter 16 be worn by a person on boat 14 to indicate that person's entry into the water 32 after leaving boat 14. This is especially useful if the entry into the water 32 by such person is accidental. In any case, transmitter 16 generates a wireless signal 34, typically a radio signal which is acquired by a receiver 22 of the type described in U.S. Pat. No. 6,157,303. Receiver 22 is capable of generating an output signal 24 which eventually shuts off or stops marine engine 12A or 12B. In addition, boat 14 typically includes a marine ladder 26 having a switch 28 which generates a positioning signal 30, that is also capable of being acquired by receiver 22 to eventually stop marine engine 12. Thus, the event of transmitter 16 contacting body of water 32 or marine ladder being deployed, independently, stop marine engine 12 according to the embodiment of the present invention. In certain cases, ladder 26 may not exist, especially on smaller boats, and, thus, only transmitter 16 would be employed to shut down marine engine 12. Also, other events such as the presence of carbon monoxide may trigger an emergency signal to activate receiver 22.

Figure 4:
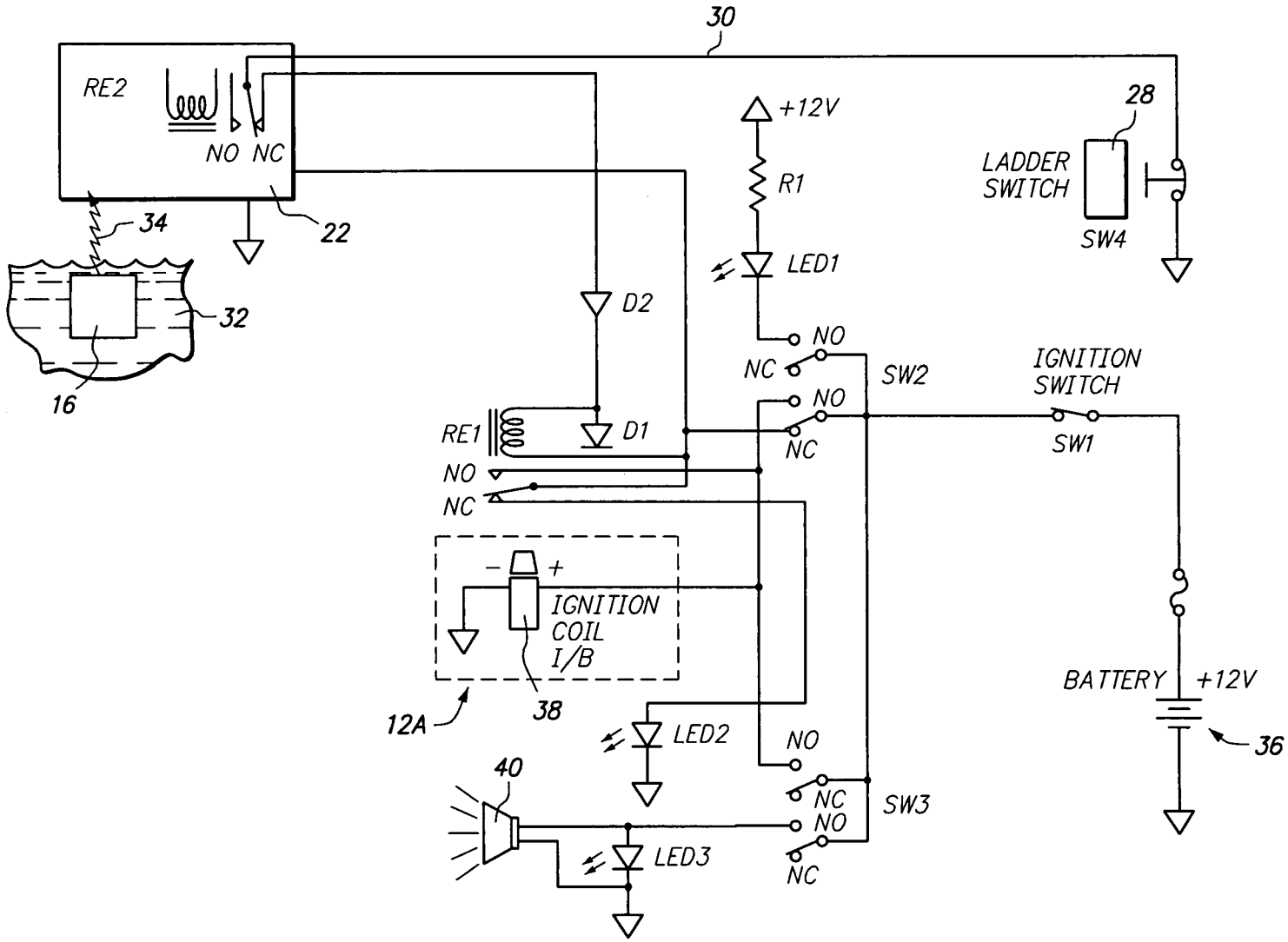
FIG. 4 is a diagram showing a circuitry employable in the present invention for use with an inboard engine.

Turning to FIG. 4, it may be observed that a circuit using transmitter 16 has been depicted, where transmitter is contacting body of water 32 generating a wireless signal 34 which is acquired by receiver 22. FIG. 4, however, indicates the normal operation of an inboard engine 10A on a boat, i.e. where inboard engine 12A is running. In this rendition, ignition switch SW1 is closed allowing electrical current to flow through relays RE1 and RE2. Current is then passed to ignition coil 38 permitting the operator to start inboard engine 12A and to operate boat 14. It should be noted that internal bypass switches SW2 and SW3 are closed at this time. Ladder switch 28, SW4, is also open at this time. Again referring to FIG. 4, it may be apparent that transmitter 16 is depicted in body of water 32 and is generating wireless signal 34. When receiver 22 acquires such signal, the relay RE2 will energize. The NC contact of RE2 will open to its NO position and the relay coil of RE1 will be ungrounded. Subsequently, the contacts of RE1 will move from its NO position to its NC position through the deactivation of the coil in RE1. Such movement of RE1 will interrupt the power to the positive side of the engine ignition coil 38 of inboard engine 12A causing the inboard engine 38 to stop running. It should be seen, that power would also be diverted to LED2 illuminating such LED and indicating trouble where LED is located, commonly at the helm of the boat 14. It should be further observed that the contacts of ladder switch SW4 are connected in series with the contacts of RE2 in receiver 22. Thus, if any of such switch 28 contacts are open, the same effect would occur, resulting in the shutting down the ignition coil 38 of inboard engine 12A. Of course, ladder switch 28 would be open when ladder 26 is lowered into the water 32. At this point, should the operator of boat 14 conclude that either receiver 22 or ladder switch 28 is defective, bypass switch SW3, which may be located at the helm, may be thrown to override the interruption mechanism initiated by receiver 22 or ladder switch 28. In such case, the double throw switch SW3 will move from the NC positions to the NO positions. Power is then diverted from the ignition switch SW1 to the bypass switch SW3 at its NO positions. An audio alarm in the form of a horn 40 will then perform an alerting function. Also, LED3 will be illuminated at this time indicating an emergency to the operator of boat 14. LED3 will normally be located at the helm of boat 14, also. Further, electrical power will pass through SW3 to the positive side of ignition coil 38 allowing inboard engine 12A to run again. Likewise, internal bypass switch SW2 would produce the same effect as the switching of bypass switch SW3. For example, SW3 would normally be located at the helm of the boat while internal bypass switch SW2 would be located in another portion of the boat. In any case, when the double throws of SW2 move from the NC to the NO positions, power is diverted from ignition switch SW1 to the circuit ground through R1, illuminating LED1. Also, power is diverted to the positive side of the ignition coil 38 through SW2 permitting the engine 12A to run again. Of course, when ignition switch SW1 is in its off position, inboard engine 12A is not operating.

Figure 5:
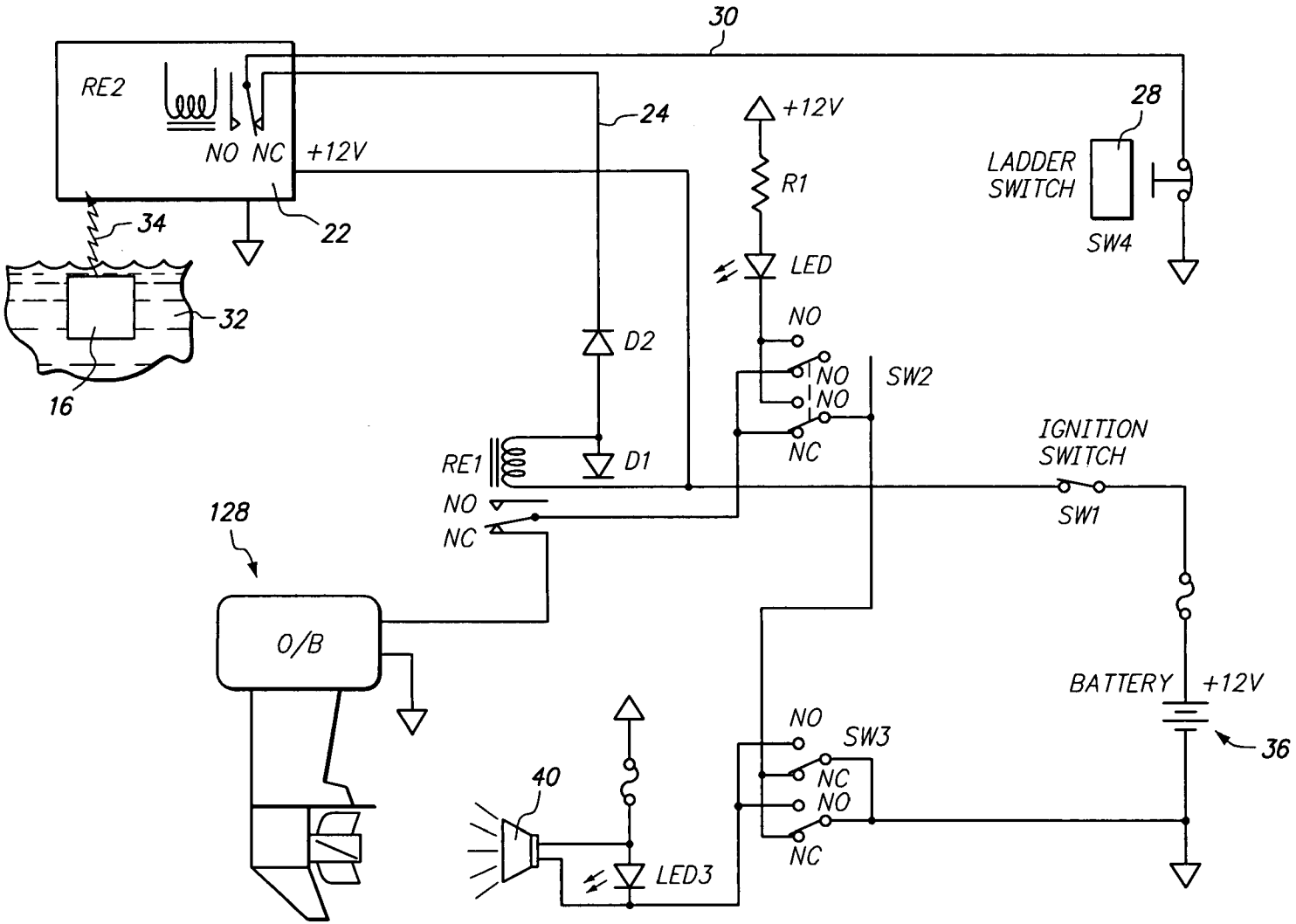
FIG. 5 is a diagram showing a circuit usable with the present invention and is applicable to an outboard engine.

Turning to FIG. 5, a circuit is illustrated and is employed in the present invention with respect to outboard marine engine 12B. In the status shown in FIG. 5, outboard engine 12B is in its normal operating position. That is, vessel ignition switch SW1 has been closed such that power from battery 38 is fed to the coil of relay 1. Such power passes through D2 and through the contacts of RE2 to the closed ladder switch 28, SW4. Relay RE1 is energized opening the connection between the contacts of RE1. The opening of relay RE1 lifts or removes the ground from the stator (not shown) of outboard engine 12B permitting it to start and run. Again, when transmitter 16 generates the wireless signal 34 to receiver 22, RE2 is energized and the contacts of RE2 move from the NC to the NO position. Consequently, the contacts of RE1 will move from the NO to the NC position bringing or applying a circuit ground to the stator of outboard engine 12B via the bypass switch SW3 which is in the NC position. Outboard motor 12B will not be able to run at this time. The operation of bypass switch SW3, normally at the helm or bypass switch SW2, will eventually operate relay RE1 and remove the ground from outboard motor 12*b* permitting it to operate. Such switches, again, would be activated should a defect be detected in receiver 22 or the ladder switch 28. Operation of the helm bypass switch SW3 activates horn 40 in the same manner as described in the inboard engine circuitry of FIG. 4.

The following Table identifies the components employed in the circuitry depicted in FIG. 4 or 5.

COMPONENT TABLE

| | |
|---|---|
| R1 | 470 OHM RESISTOR |
| D1 | DIODE |
| D2 | DIODE |
| RE1 | IGNITION RELAY |
| RE2 | RECEIVER RELAY |
| LED1 | INTERNAL BYPASS LED |
| LED2 | LADDER DOWN OR TRANSMITTER ACTIVATED LED |
| LED3 | HELM BYPASS LED |
| SW1 | IGNITION SWITCH |
| SW2 | INTERNAL BYPASS SWITCH |
| SW3 | HELM BYPASS SWITCH |

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A device for shutting off a marine engine of a boat having an ignition system, comprising:

a. a transmitter for generating a wireless signal upon association with water;

b. a receiver for acquiring said wireless signal and generating an output signal therefrom;

c. a disconnection apparatus for interrupting operation of the marine engine ignition system upon receipt of said output signal from said receiver; and d. an override mechanism to reactivate the marine engine ignition system by said disconnection apparatus, said override mechanism including a first bypass switch, and a second bypass switch said first and second bypass switches being located in distinct portions of the boat.

2. The device of claim 1 in which said disconnection apparatus further includes said output signal of said receiver comprising and electrical signal.

3. The device of claim 2 in said disconnection apparatus includes a relay, said relay receiving said electrical signal which operates said relay to interrupt the operation of the marine engine.

4. The device of claim 3 in which said relay comprises a first relay and in which said receiver includes a second relay producing said electrical signal of said disconnection apparatus.

5. The device of claim 1 which additionally comprises an alerting mechanism indicating the activation of said override mechanism.

6. The device of claim 1 in which said alerting mechanism comprises an audio alarm.

7. A device for shutting off a marine engine of a boat, having an ignition system, comprising:

a. a transmitter for generating a wireless signal upon association with water;

b. a switch activated upon the occurrence of a marine event, said switch generation an event signal;

c. a receiver for acquiring said wireless signal from said transmitter and generating an output upon receipt of aid wireless signal from said transmitter; and d. a disconnection apparatus for interrupting operation of marine engine ignition system upon receipt of said output signal from said receiver or said event signal from said switch activated upon the occurrence of a marine event.

8. The device of claim 7 in which said disconnection apparatus further includes one relay generating a signal to interrupt the operation of the marine engine upon receipt of the output signal from said receiver or said event signal from said switch activated upon the occurrences of the marine event.

9. The device of claim 8 which further includes another relay receiving said signal from said one relay to interrupt the operation of the marine engine.

10. The device of claim 7 which additionally comprises an override mechanism to reactivate the marine engine ignition system following interruption of the operation of the marine engine ignition system by said disconnection apparatus.

11. The device of claim 10 which said override mechanism further comprises a first bypass switch and a second bypass switch said first and second bypass switches being located in distinct portions of the boat.

12. The device of claim 11 which additionally comprises an alerting mechanism indicating the activation of said override mechanism.

13. The device of claim 12 in which said alerting mechanism comprises an audio alarm.

14. The device of claim 7 in which said event signal from said switch activated upon the occurrence of a marine event, comprises an event signal from said switch generated upon the positioning of a marine ladder.

15. The device of claim 7 in which said event signal from said switch activated upon the occurrence of a marine event, comprises an event signal from said switch generated upon the detection of carbon monoxide.

* * * * *